United States Patent [19]

Warner et al.

[11] 4,106,520

[45] Aug. 15, 1978

[54] ENCLOSURE

[76] Inventors: Gerhardt Allan Warner; Kurt Ehrich Warner, both of 97 Canora Street, Winnipeg, Manitoba, Canada

[21] Appl. No.: 797,520

[22] Filed: May 16, 1977

[30] Foreign Application Priority Data

Oct. 5, 1976 [GB] United Kingdom ..... 41287/76

[51] Int. Cl.[2] ..... A45F 1/16

[52] U.S. Cl. ..... 135/4 R; D25/19; D25/31; 52/66; 135/15 PE; 135/DIG. 1

[58] Field of Search ..... 135/DIG. 1, 1 R, 3 R, 135/4 R, DIG. 8, 15 PE; 52/63, 64, 66, 67; D25/13, 18, 19, 31

[56] References Cited

U.S. PATENT DOCUMENTS

| | | | |
|---|---|---|---|
| 2,716,993 | 9/1955 | Codrick | 135/4 R |
| 2,856,942 | 10/1958 | Scott | 135/4 R |
| 3,848,615 | 11/1974 | Warner et al. | 135/4 R |

FOREIGN PATENT DOCUMENTS

| | | | |
|---|---|---|---|
| 1,281,038 | 11/1961 | France | 52/80 |
| 1,325,748 | 3/1963 | France | 135/4 R |

*Primary Examiner*—Werner H. Schroeder
*Assistant Examiner*—Conrad L. Berman
*Attorney, Agent, or Firm*—Stanley G. Ade

[57] ABSTRACT

A shelter comprises at least two sets of arched support ribs with the support ribs of each set being pivoted by the adjacent ends thereof upon a common locus and having one set of support ribs over spanning the other set at an angle to each other. Some of the intersections are secured together and a flexible cover is secured over the support ribs. By situating the end support ribs in a plane at an angle to the supporting surface upon which the shelter is erected, substantially triangular openings are defined which can be used for access if required.

9 Claims, 9 Drawing Figures

FIG. 1
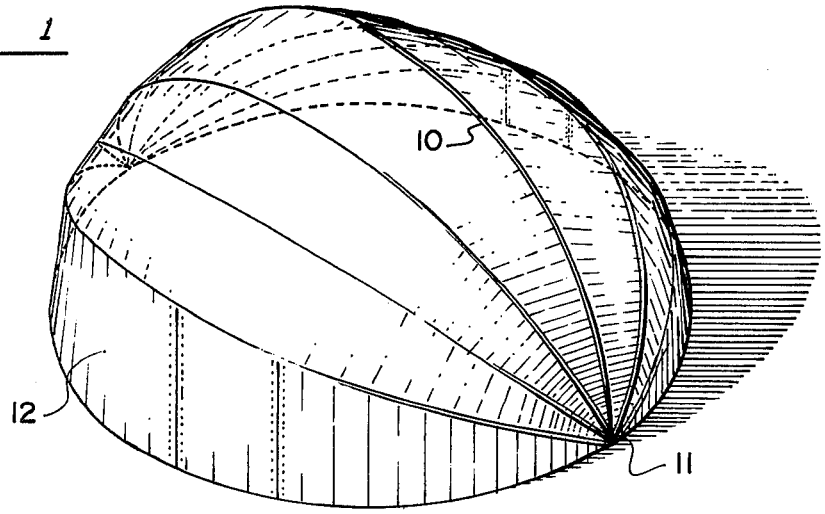
FIG. 3
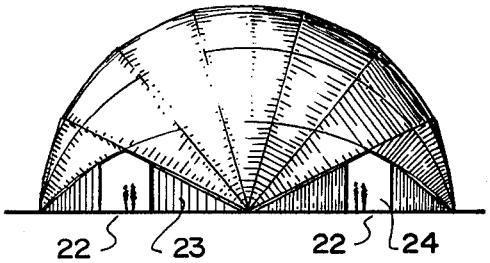
FIG. 2
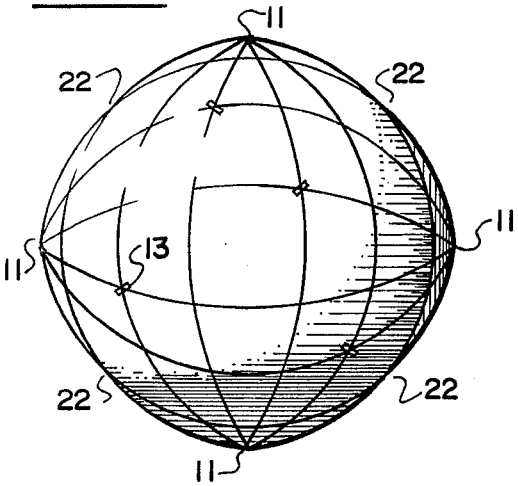
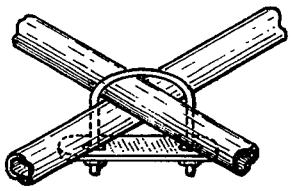
FIG. 3A
FIG. 4
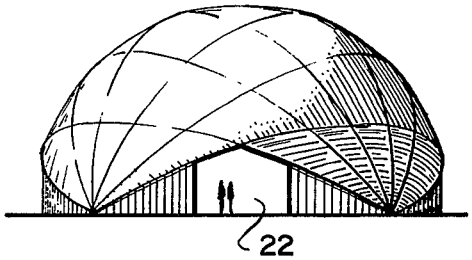

ENCLOSURE

BACKGROUND OF THE INVENTION

This invention relates to new and useful improvements in portable and transportable shelters, particularly substantially circular shelters when viewed in plan or hemispherical shelters when viewed in side elevation.

Although relatively small shelters are well known which consist of coils of spring steel covered with a flexible fabric cover, nevertheless these are not always suitable for use in various environments.

Furthermore they are somewhat limited in size and application.

SUMMARY OF THE INVENTION

The present invention overcomes these disadvantages firstly by providing a shelter which can be of any desired size and which furthermore can be strengthened as desired by erecting two or more sets of frames at an angle to one another and securing the frames together where they intersect thus providing an extremely strong dome like shelter not requiring any external supports and having a clear span therewithin without the necessity of vertical or diagonal supports or pillars.

The principle object and essence of the invention is therefore to provide a device of the character herewithin described in which the frame comprises a plurality of substantially semi circular arched support ribs pivoted together on a common locus and having two or more sets of support ribs situated at an angle to one another with connections being made at the intersections of the support ribs. A flexible cover may be secured over the outer most set of support ribs or, alternatively, a flexible cover may be provided on both sets of support ribs depending upon design parameters.

Another object of the invention is therefore to provide a device of the character herewithin described in which, if two sets of support ribs are erected at right angles to one another, access openings are provided at approximately 45° to one another which may or may not be enclosed depending upon the use to which the shelter is being placed.

Another object of the invention is to provide a device of the character herewithin described in which all stresses are automatically transferred to pivot anchors to which the bases of all the support ribs are secured.

Another object of the invention is to provide a device of the character herewithin described which is simple in construction, economical in manufacture and otherwise well suited to the purpose for which it is designed.

Another object of the invention is to provide a device of the character herewithin described which is extremely resistant to wind and snow loading due to the hoops following a predetermined curve and the two or more sets of support ribs being joined at their intersections forming a multitude of spherical triangles which, by their inherent nature, are extremely strong.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawing in which:

DESCRIPTION OF THE DRAWINGS

FIG. 1 is an isometric view of one set of support ribs shown in the erected position.

FIG. 2 is a top plan view of two sets of support ribs situated at right angles to one another.

FIG. 3 is a side view of FIG. 2.

FIG. 3A is a fragmentary isometric view of one of the methods of connecting the support ribs at their intersections.

FIG. 4 is an 45° elevation view of FIG. 2 showing one of the entrance and exit triangles.

In the drawings like characters of reference indicate corresponding parts in the different figures.

DETAILED DESCRIPTION

Figure 5:
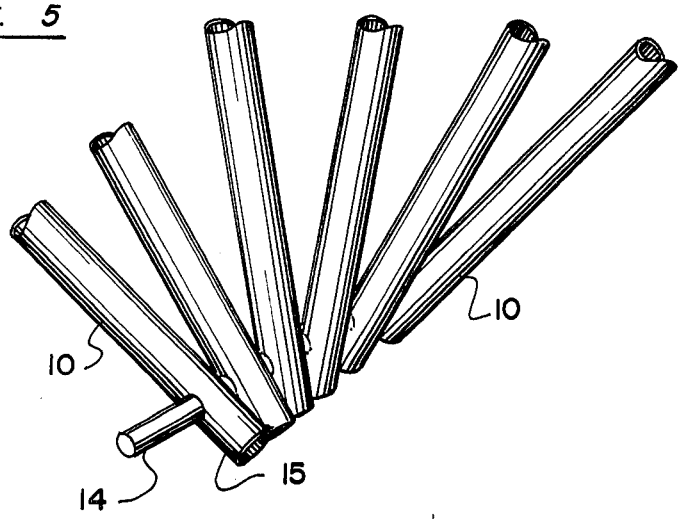
FIG. 5 is a fragmentary isometric view of one end of a set of support ribs pivoted on a common locus.

Proceeding therefore to describe the invention in detail, at least two sets of arched support ribs are provided and each set of hoops comprises a plurality of semi circular or curved ribs 10 pivoted on a common locus by the ends thereof as indicated by reference character 11 so that they can be collapsed one upon the other for transportation and storage or can be erected to form a dome shaped or substantially hemispherical frame as illustrated in FIG. 1. The support ribs may be formed from solid or tubular stock as desired.

A cover shown schematically in FIG. 1 and indicated by reference character 12, is made of flexible fabric or the like and may be secured to the individual support ribs or frames so that it opens and closes therewith. This securement may be by ties or pockets or sleeves secured to the inner surface of the support ribs at convenient locations (not illustrated).

It is preferable that at least two sets of support ribs are utilized in the erection of the structure, one set of support ribs being erected first and then a second set at an angle thereto and having a radius just slightly larger than the first set. Preferably the two sets of support ribs should be situated at right angles to one another.

This provides an intersecting structure shown in plan view in FIG. 2 and the intersections of the support ribs of each set are clamped together by means such as a U bolt assembly illustrated by reference character 13 in FIG. 2.

The ends of the support ribs of each set of ribs are pivoted on a common locus 11 as hereinbefore described and various methods may be provided to form this anchoring and pivot assembly.

Figure 6:
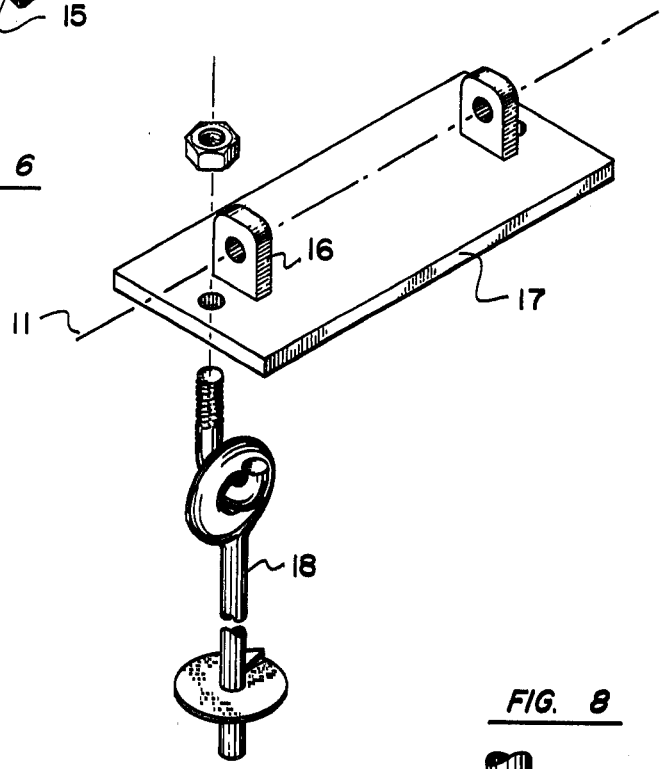
FIG. 6 is an isometric partially exploded view of one typical anchoring and pivoting means.

FIG. 5 shows a pivot bolt 14 engaging through the apertured ends 15 of adjacent support ribs 10 and this bolt may engage a pair of spaced apart lugs 16 extending upwardly from a pivot plate 17 which in turn may be screw anchored to the ground or supporting surface as illustrated by reference character 18 in FIG. 6.

Figure 7:
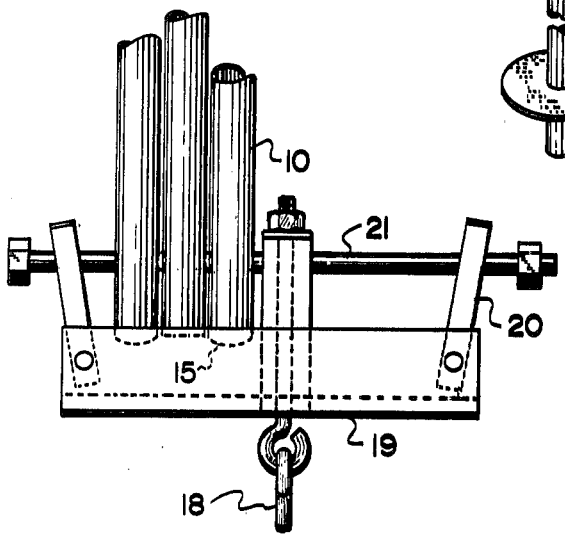
FIG. 7 is a side elevation of an alternate pivoting and anchoring means.
Figure 8:
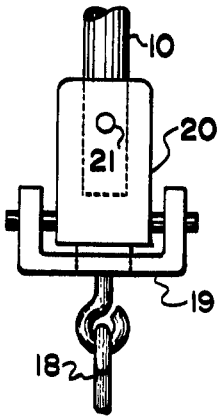
FIG. 8 is an end view of FIG. 7.

Alternatively, as shown in FIGS. 7 and 8, channel 19 may be provided with pivoted end plates 20 and a cross bolt 21 engaging through the end plates with the apertured ends 15 of the support ribs 10 engaging over the cross bolts 21. The pivoted plates 20 are provided so that the cross bolt and ends 15 can be assembled within the channel when desired.

When two sets of support ribs are erected as illustrated in FIGS. 2 and 3, a single cover can be secured to the outer set or, alternatively, covers can be attached to both sets depending upon design.

It will be noted that the outer support ribs of each set may be spaced above the ground or supporting surface as shown in FIG. 3 so that the configuration of two sets situated at right angles to one another, gives four substantially triangular entrance areas 22 which either may be left open, or may be closed by panelling 23 with doorways 24 left therein and FIG. 4 shows the configuration of such openings.

If a further set of support ribs frames is utilized, then the angles between the three or four sets are adjusted to make them equal thus giving additional strength to the structure once again depending upon its size and the design thereof.

Alternatively access openings may be provided on one side only with the support ribs of one set on the other side extending to the ground or supporting surface. The outer support ribs defining the openings are located in a plane at an angle to the horizontal, the angle being determined by the design height of the openings. These outer support ribs are held in position by clamping same at the intersections thereof to the adjacent support ribs of the other set.

It should be stressed that each set of support ribs is provided with two opposed anchoring and pivoting assemblies thus anchoring the structure firmly to the ground or supporting surface and that the pivot assemblies of each set have different pivot axes.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What we claim as our invention:

1. An enclosure structure for erection upon a supporting surface and comprising in combination at least two sets of arched support ribs and a flexible cover for said support ribs, means for each set of support ribs pivoting the adjacent ends of each set of support ribs on common loci, each set of support ribs being situated in angular relationship to one another whereby said means pivoting the adjacent ends of each set of support ribs have different pivot axes, and means clamping some of said support ribs of one set of support ribs to some of said support ribs of the other set of support ribs at the intersections thereof.

2. The structure according to claim 1 in which said means pivoting the adjacent ends of each set of support ribs on a common locus includes a pivot pin mounting the said adjacent ends of said support ribs, a support member, a pair of lugs extending upwardly from said support member, engageable by said pivot pin for supporting same and anchor means for detachably securing said support member to the supporting surface.

3. The structure according to claim 2 in which said lugs are pivoted to said support member to facilitate mounting and dismounting said adjacent ends thereon.

4. The structure according to claim 1 in which each set of support ribs includes outer support ribs and at least one intermediate support rib therebetween.

5. The structure according to claim 4 in which said means pivoting the adjacent ends of each set of support ribs on a common locus includes a pivot pin mounting the said adjacent ends of said support ribs, a support member, a pair of lugs extending upwardly from said support member, engageable by said pivot pin for supporting same and anchor means for detachably securing said support member to the supporting surface.

6. The structure according to claim 5 in which said lugs are pivoted to said support member to facilitate mounting and dismounting said adjacent ends thereon.

7. The structure according to claim 4 in which at least one outer support rib of each set is situated in a plane at an angle to the horizontal when erected, thus defining at least two access openings in said structure.

8. The structure according to claim 7 in which said means pivoting the adjacent ends of each set of support ribs on a common locus includes a pivot pin mounting the said adjacent ends of said support ribs, a support member, a pair of lugs extending upwardly from said support member, engageable by said pivot pin for supporting same and anchor means for detachably securing said support member to the supporting surface.

9. The structure according to claim 5 in which said lugs are pivoted to said support member to facilitate mounting and dismounting said adjacent ends thereon.

* * * * *